United States Patent [19]

Townsend et al.

[11] Patent Number: 5,055,069

[45] Date of Patent: Oct. 8, 1991

[54] CONNECTORS WITH GROUND STRUCTURE

[75] Inventors: Peter K. Townsend, Camp Hill; David F. Fusselman, Middletown, both of Pa.

[73] Assignee: E. I. Du Pont de Nemours and Company, Wilmington, Del.

[21] Appl. No.: 535,432

[22] Filed: Jun. 8, 1990

[51] Int. Cl.[5] ..... H01R 13/648

[52] U.S. Cl. ..... 439/608; 439/80

[58] Field of Search ..... 439/81, 80, 607-610

[56] References Cited

U.S. PATENT DOCUMENTS

| | | | |
|---|---|---|---|
| 4,568,134 | 2/1986 | DiMondi | 439/680 |
| 4,601,527 | 7/1986 | Lemke | 439/81 |
| 4,655,518 | 4/1987 | Johnson et al. | 439/62 |
| 4,686,607 | 8/1987 | Johnson | 361/413 |
| 4,806,107 | 2/1989 | Arnold et al. | 439/79 |
| 4,824,383 | 4/1989 | Lemke | 439/108 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,898,546 | 2/1990 | Elio et al. | 439/608 |

*Primary Examiner*—Joseph H. McGlynn
*Assistant Examiner*—Hien D. Vu
*Attorney, Agent, or Firm*—John E. Griffiths

[57] ABSTRACT

This invention relates to electrical connectors with a ground structure for impedance and cross talk control between signal carrying conductors and, in particular, where the connector is a right angle or angled receptacle.

33 Claims, 10 Drawing Sheets

CONNECTORS WITH GROUND STRUCTURE

BACKGROUND OF THE INVENTION

1. Field of the Invention

This invention relates to electrical connectors with a ground structure for impedance and cross talk control between signal carrying conductors and, in particular, where the connector is a right angle receptacle or a right angle header.

2. Description of Related Art

With the advance of technology, a high density of electronic circuits and components can be located on a printed wiring board or printed circuit board (PCB). Along with this miniturization of electronic circuits and components, electrical connectors are needed to electrically and mechanically interconnect one PCB, such as a back panel or mother board, to one or more other PCBs, such as daughter boards. Further, it is typically desireable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), 4,686,607 (to Lennart B. Johnson) and 4,869,677 (to Lennart B. Johnson et al.) disclose a daughter board-/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide a high density right angle electrical connector for electrically and mechanically interconnecting electronic circuits and/or components controlling impedance and/or cross talk within the connector.

Furthermore, it is an object of this invention to provide a high density right angle or angled electrical receptacle for electrically and mechanically interconnecting a circuit assembly and a plurality of terminals arranged in rows and columns in a header or shroud to control impedance and/or cross talk thereby to reduce, prevent or minimize degradation of signal transmission within the receptacle.

Furthermore, it is an object of this invention to provide a high density right angle or angled electrical header for electrically and mechanically interconnecting a circuit assembly and a plurality of terminals arranged in rows and columns in a receptacle to control impedance and/or cross talk thereby to reduce, prevent or minimize degradation of signal transmission within the header.

SUMMARY OF THE INVENTION

The present invention is directed to a right angle or angled electrical connector for electrically and mechanically interconnecting a circuit assembly and a second connector having a plurality of terminals, each terminal having a first contact, the first contacts arranged in rows and columns, the right angle or angled connector comprising:

an insulative housing;

a plurality of electrical contact elements in the housing wherein:

each one of the contact elements has a second contact and a third contact, the second contacts are arranged in rows and columns for contacting the first contacts, each one of the contact elements, except the contact elements with their second contacts in the nth row, includes a middle portion configured such that their third contacts extend at an angle with respect to the second contacts, a first set of a plurality of the contact elements with their second contacts in the nth row having a middle portion configured such that their third contacts extend at an angle with respect to the second contacts, and a second set of a plurality of the contact elements with their second contacts in the nth row; and a conductive shield electrically connected to the second set of the contact elements.

The present invention is further directed to a right angle or angled electrical connector for electrically and mechanically interconnecting a circuit assembly and a second connector having a plurality of terminals, each terminal having a first contact, the first contacts arranged in rows and columns, the right angle or angled connector comprising:

an insulative housing;

a plurality of electrical contact elements in the housing wherein:

each one of the contact elements has a second contact and a third contact, the second contacts are arranged in rows and columns for contacting the first contacts, each one of the contact elements, except the contact elements with their second contacts in the nth row, includes a middle portion configured such that their third contacts extend at an angle with respect to the second contacts, a first set of the contact elements with their second contacts in the nth row having a middle portion configured such that their third contacts extend at an angle with respect to the second contacts, and a second set of the contact elements with their second contacts in the nth row; and a conductive shield including:

a baffle positioned between and spaced from columns of the middle portions of the contact elements, a fourth contact for contacting each of the third contacts of the second set of the contact elements, and a plurality of fifth contacts positioned such that the third contacts, excluding the third contacts of the second set of contact elements in the nth row, and the fifth contacts are arranged in rows and columns for connection to the circuit assembly.

The present invention is further directed to a conductive shield for reducing cross talk between contact elements in right angle or angled connectors having an insulative housing and a plurality of the contact elements mounted in the housing, each one of the contact elements having a first contact and a second contact, the first contacts arranged in rows and columns, the shield comprising:

a plurality of baffles, each of the baffles for positioning between adjacent columns of middle portions of the contact elements such that the baffles are spaced from the contact elements, a plurality of first shield contacts, one of the first shield contacts for contacting each of the second contacts of a set of the contact elements in the nth row of contact elements, and a plurality of second shield contacts positioned such that the second contacts of the connector elements, excluding the second contacts of the set of contact elements in the nth row, and the second shield contacts are arranged in rows and columns that are at an angle with respect to the rows and columns of the first contacts of the contact elements.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
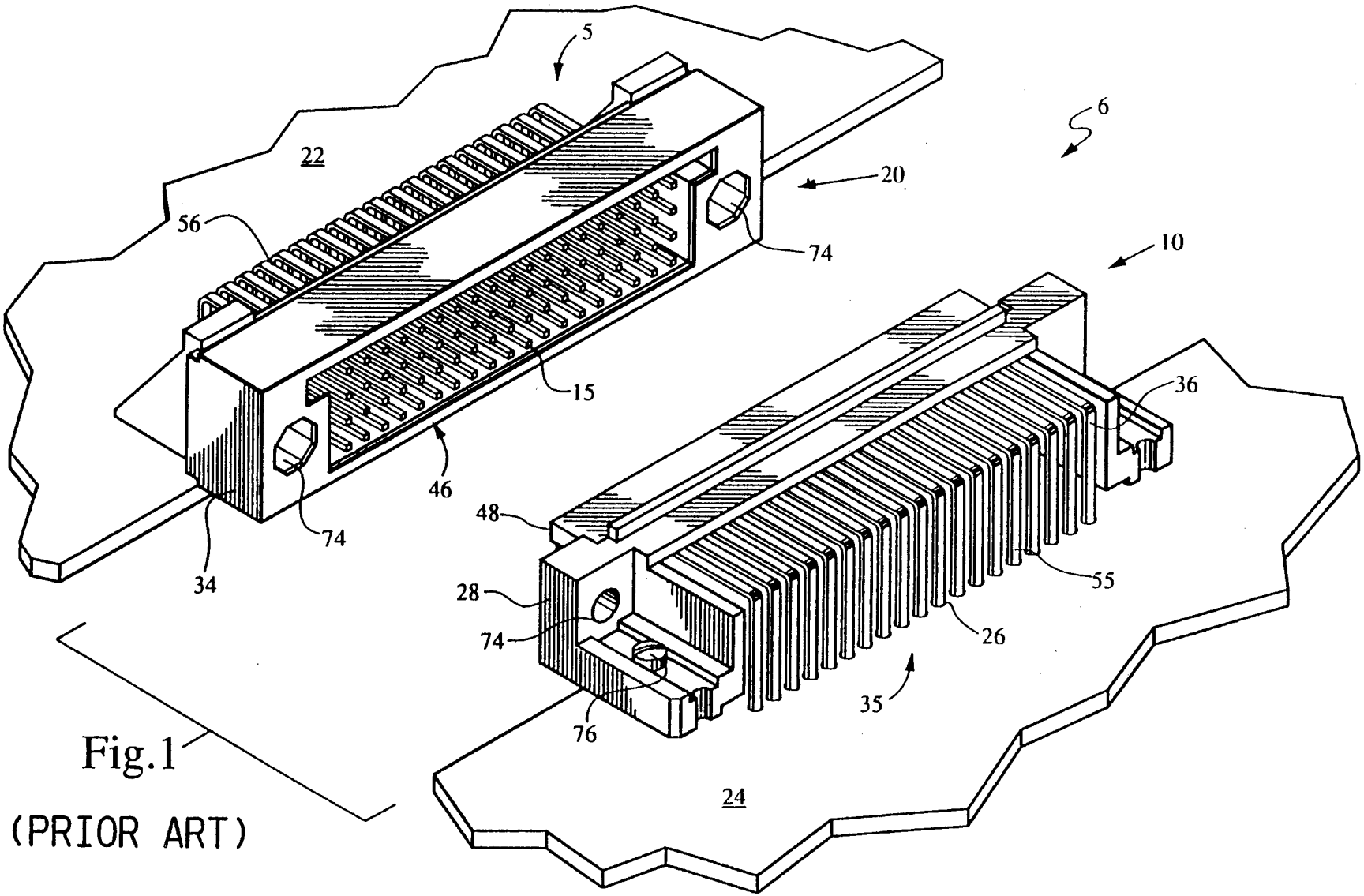
Fig.1 (PRIOR ART)
FIG. 1 is an exploded perspective view of a first prior art high density connector assembly including a right angle or angled receptacle and a right angle or angled header for interconnecting a first printed circuit or wiring board and a second printed circuit or wiring

Throughout the following detailed description, similar reference characters refer to similar elements in all figures of the drawings.

Figure 2:
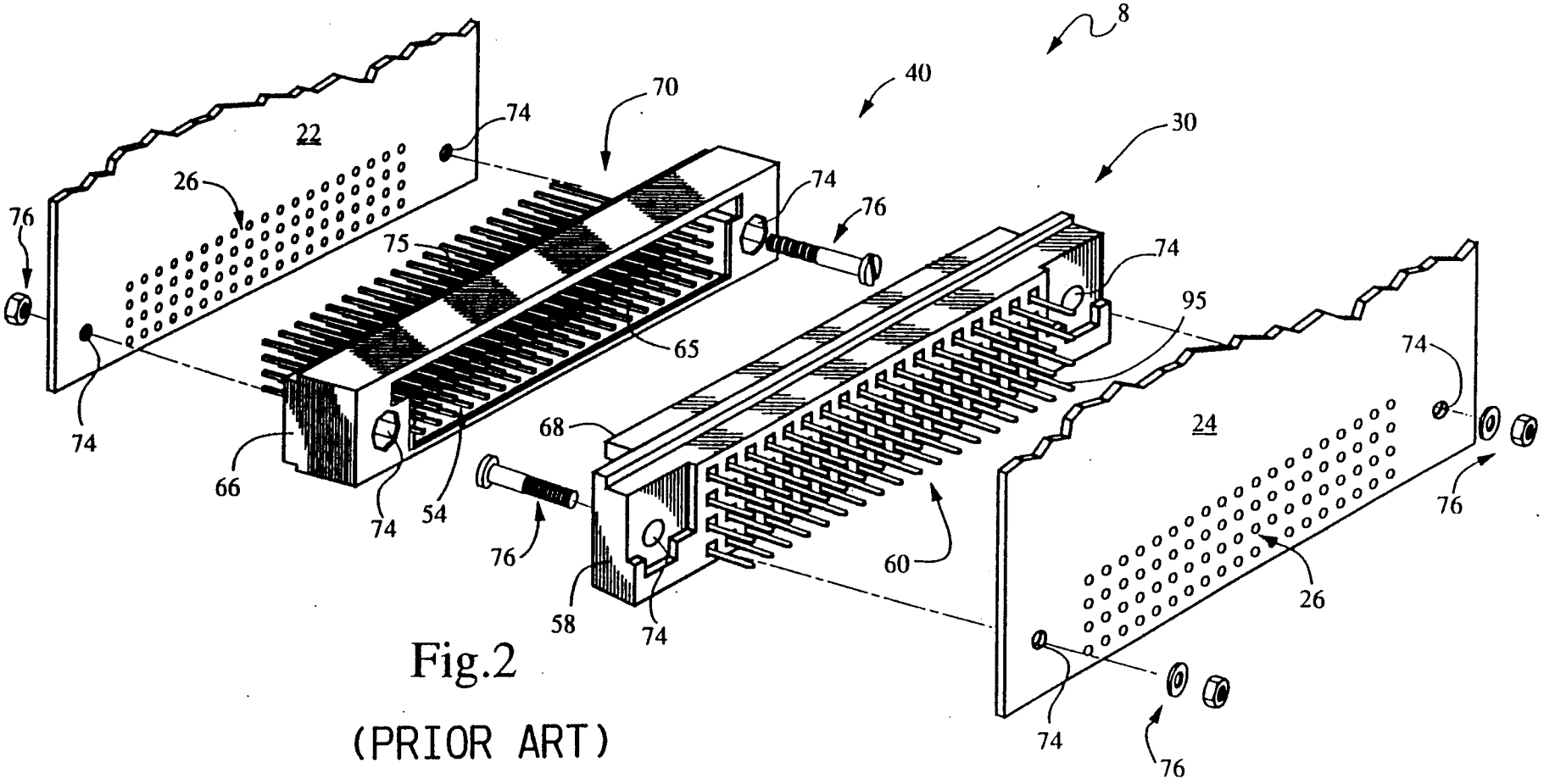
Fig.2 (PRIOR ART)
FIG. 2 is an exploded perspective view of a second prior art high density connector assembly including a vertical receptacle and a vertical header for interconnecting a first printed circuit or wiring board and a second printed circuit or wiring board.
Figure 3:
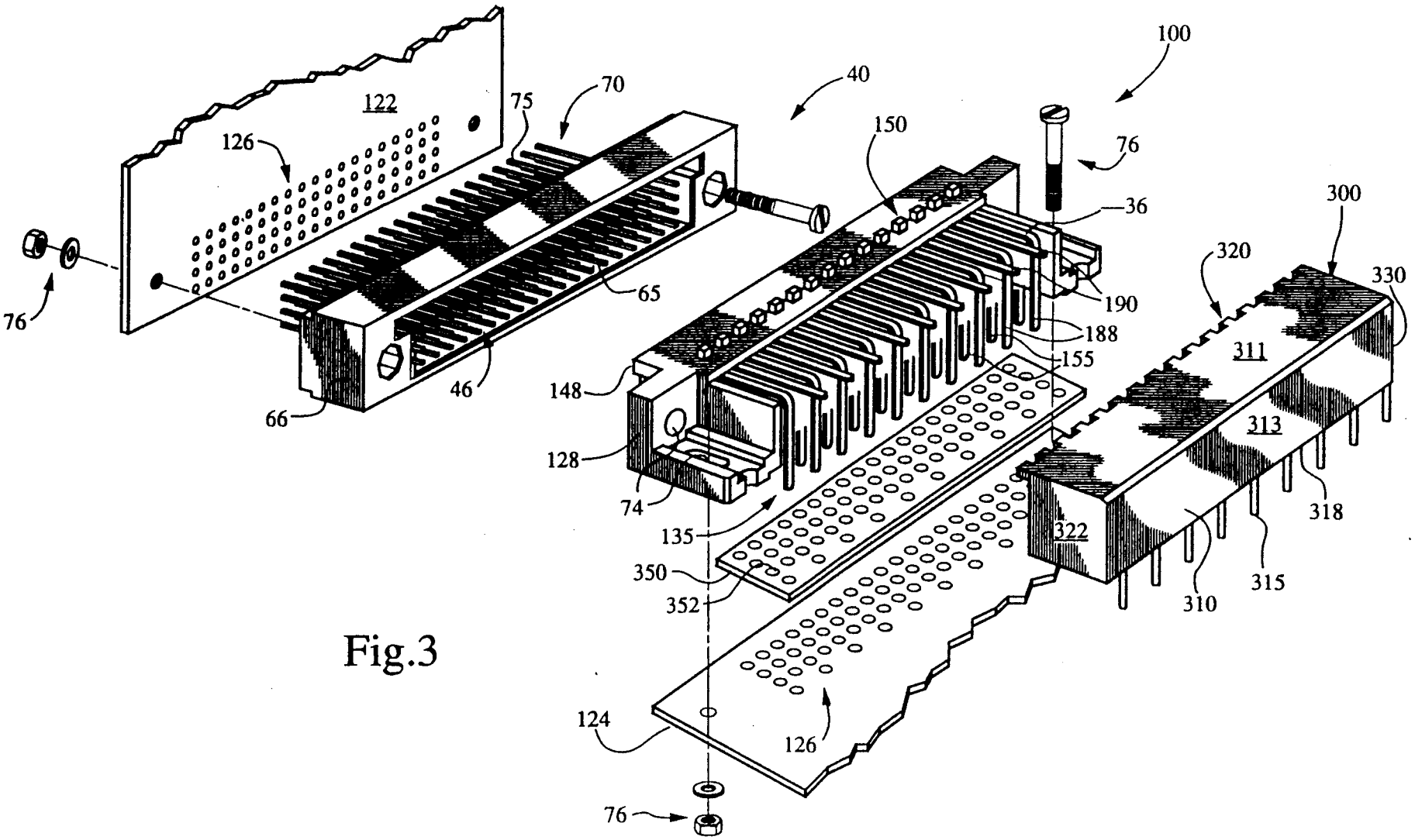
FIG. 3 is an exploded perspective view of a first embodiment of a high density connector assembly in accordance with the present invention, the assembly including a high density right angle or angled receptacle and the vertical header of FIG. 2 for interconnecting a first printed circuit or wiring board and a second printed circuit or wiring board.
Figure 10:
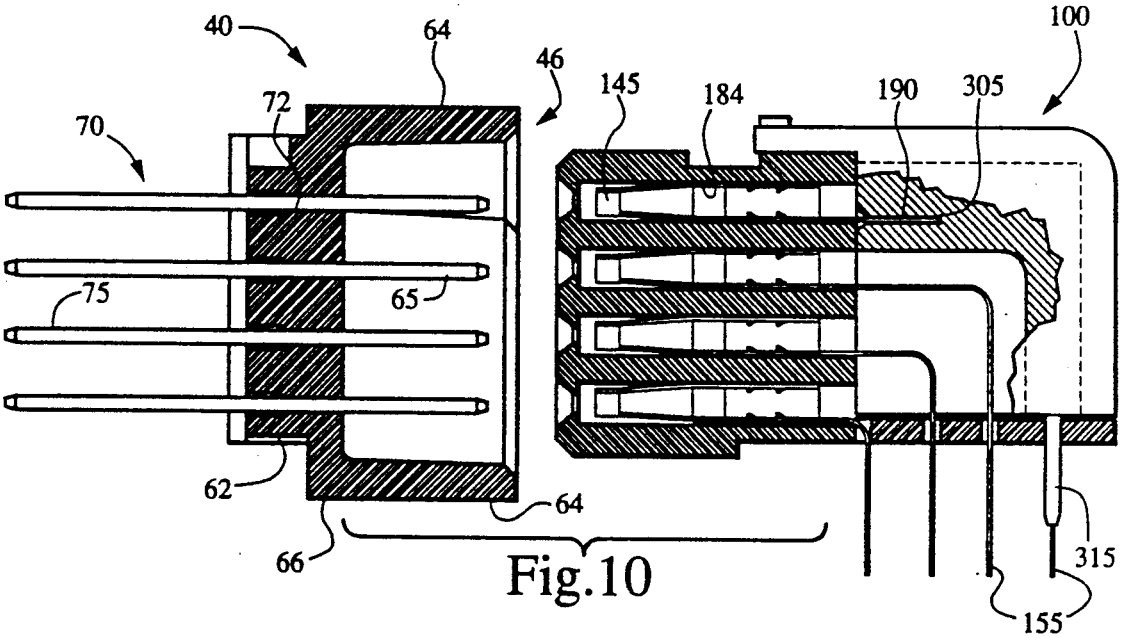
FIG. 10 is a sectional view of the right angle or angled receptacle of FIGS. 3–8 exploded from the vertical header of FIG. 2.
Figure 4A:
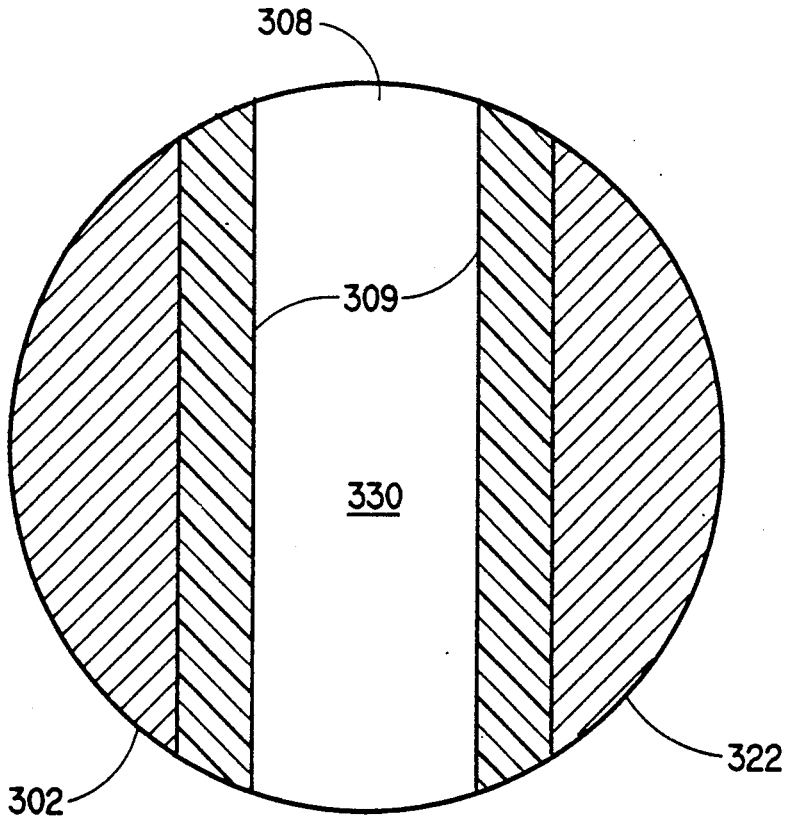
FIG. 4*a* depicts an insulative layer coating a socket.
Figure 11:
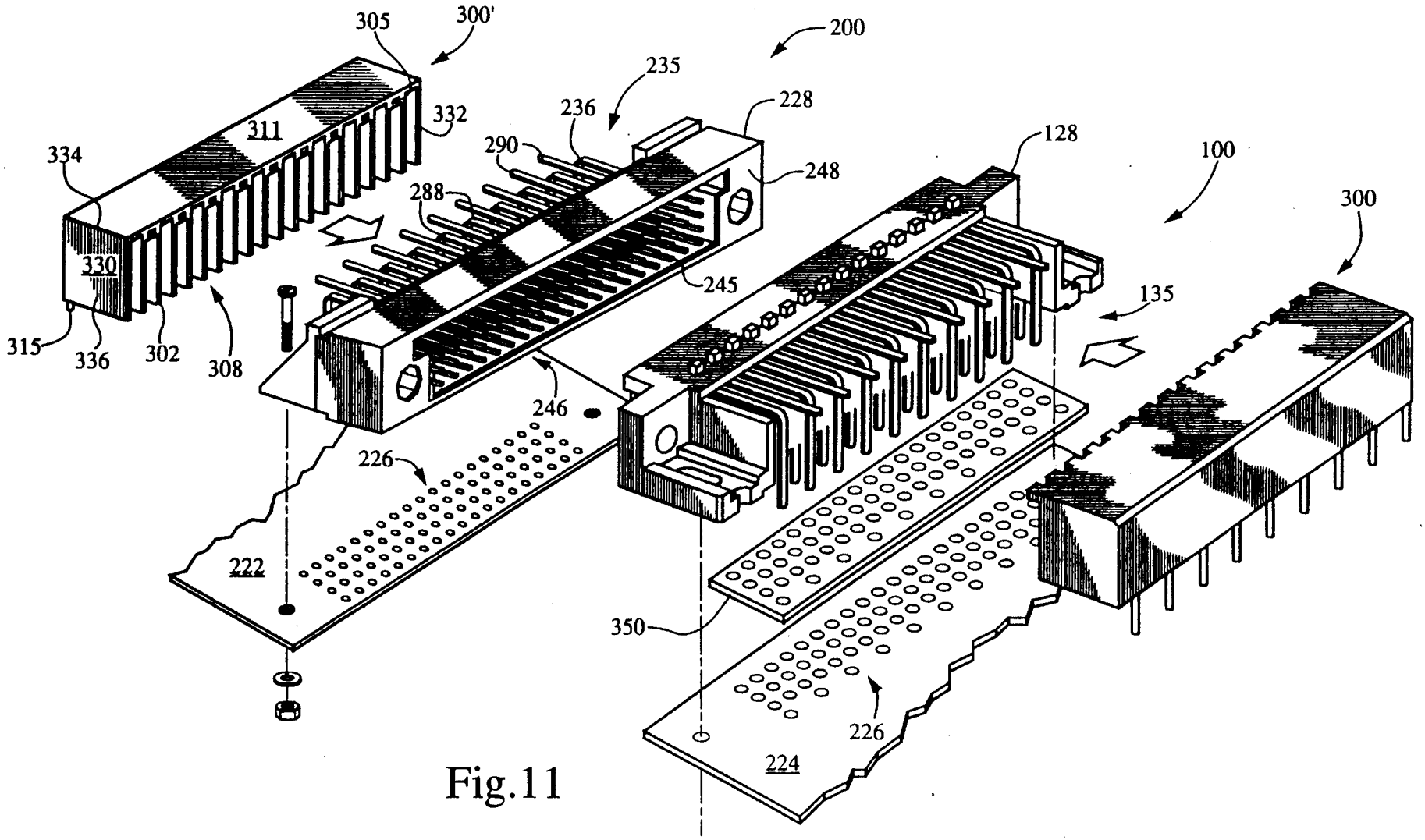
FIG. 11 is an exploded perspective view of a second embodiment of a high density connector assembly in accordance with the present invention, the assembly including the high density right angle or angled receptacle of FIGS. 3–10 and a high density right angle or angled header for interconnecting a first printed circuit or wiring board and a second printed circuit or wiring board.

FIGS. 1 and 2 illustrate prior art connector assemblies 6, 8 including prior art high density connectors 10, 20, 30, 40 interconnecting first circuit assemblies 22 and second circuit assemblies 24. With reference to FIGS. 3–10, there is illustrated a high density right angle or angled receptacle 100 in accordance with the present invention. In FIG. 3, for instance, the high density right angle or angled receptacle 100 is illustrated in combination with the prior art connector 40. With reference to FIGS. 11–20, there is illustrated a high density right angle or angled header 200 in accordance with the present invention. In FIG. 11, for instance, the high density right angle or angled header 200 is illustrated in combination with the high density right angle or angled receptacle 100. The high density right angle or angled receptacle 100 and the high density right angle or angled header 200 include a conductive shield 300 made in accordance with the present invention.

Referring to FIG. 1, there is illustrated an exploded perspective view of the first prior art high density connector assembly 6 including a high density right angle or angled receptacle 10 and a high density right angle or angled header 20 for interconnecting the first circuit assembly 22 and the second circuit assembly 24. Typically, the first circuit assembly 22 is a printed circuit board, specifically a mother board, and the second circuit assembly 24 is another printed circuit board, specifically a daughter board. Each one of the first and second printed circuit boards 22, 24 has a pattern 26 of rows and columns of conductive regions, such as plated through holes for through mounting or pads for surface mounting of connectors. In this connector assembly 6, the mother board 22 is parallel to or coplanar with the daughter board 24.

The right angle or angled receptacle 10 comprises an insulative housing 28 supporting a plurality of contact elements or terminals 35. The receptacle terminals 35 have first contacts (not depicted) positioned in passages (not depicted) through the housing 28. The receptacle first contacts (not depicted) are generally parallel to one another and are arranged in rows and columns for connecting to first contacts 15 of the header 20. The receptacle terminals 35 have second contacts 55 arranged in rows and columns for connecting to the pattern of conductive regions 26 on the daughter board 24. The receptacle terminals 35 have middle portions 36 that bend generally at a right angle or angled between the first contacts (not depicted) and the second contacts 55. The receptacle housing 28 may include insulative baffles (not depicted) positioned between and spaced from adjacent columns of the middle portions 36.

The right angle or angled header 20 comprises an insulative housing 34 including a base 42 and side walls 44 defining a contact region 46 for receiving a mating face 48 of the receptacle 10. See FIG. 9. A plurality of contact elements or terminals 5 are held in passages 52 though the base 42. The header terminals 5 have first contacts 15 positioned in the contact region 46. The header first contacts 15 are generally parallel to one another and are arranged in rows and columns for connecting to the first contacts (not depicted) of the receptacle 10. The header terminals 5 have second contacts 25 arranged in rows and columns for connecting to the pattern 26 of conductive regions on the mother board 22. The header terminals 5 have middle portions 56 that bend generally at a right angle between the first contacts 15 and the second contacts 25.

FIG. 2 is an exploded perspective view of the second prior art high density connector assembly 8 including a vertical receptacle 30 and a vertical header 40 for interconnecting the first circuit assembly 22 and the second circuit assembly 24. In this connector assembly 8, the mother board 22 is parallel to and spaced apart from the daughter board 24.

The vertical receptacle 30 comprises an insulative housing 58 supporting a plurality of contact elements or terminals 60. The receptacle terminals 60 have first contacts (not depicted) positioned in passages (not depicted) through the housing 58. The receptacle first contacts (not depicted) are generally parallel to one another and are arranged in rows and columns for connecting to first contacts 65 of the header 40. The receptacle terminals 60 have second contacts 95 arranged in rows and columns for connecting to the pattern 26 of conductive regions on the daughter board 24. The receptacle terminals 60 have generally straight middle portions.

The vertical header 40 comprises an insulative housing 66 including a base 62 and side walls 64 defining a contact region 54 for receiving a mating face 68 of the receptacle 30. A plurality of contact elements or terminals 70 are held in passages 72 though the base 62. The header terminals 70 have first contacts 65 positioned in the contact region 54. The header first contacts 65 are generally parallel to one another and are arranged in rows and columns for connecting to the first contacts (not depicted) of the receptacle 30. The header terminals 70 have second contacts 75 arranged in rows and columns for connecting to the pattern 26 of conductive regions on the mother board 22. The header terminals 70 have generally straight middle portions.

Each of the four connectors 10, 20, 30, 40 illustrated in FIG. 1 and 2 can have holes 74 and corresponding securing or guide pin assemblies 76 for mounting one connector to another connector or to a printed circuit board. The holes 74 and pins in the pin assemblies 76 can have key shapes as described in U.S. Pat. No. 4,568,134.

It is also well known to use either the vertical header 40 in combination with the right angle or angled receptacle 10 or the right angle or angled header 20 in combination with the vertical receptacle 30 to interconnect a mother board 22 that is perpendicular to a daughter board 24.

FIGS. 1 and 2 illustrate particular prior art headers 20, 40 and receptacles 10, 30 from the High Pin Count (HPC) product line available from E. I. du Pont de Nemours and Company with offices in Wilmington, Del. However, they are illustrative of connectors in many other product lines including the Metral product line and the Din series of connectors, both also commercially available from E. I. du Pont de Nemours and Company. Each of these product lines includes vertical and right angle connectors having a plurality of contact elements arranged in rows and columns. However, the size and/or shape of the contact elements and/or housings may differ.

FIG. 3 is an exploded perspective view of a first embodiment of a high density connector assembly in accordance with the present invention. The assembly includes a high density right angle or angled receptacle 100 and the high density header 40 for interconnecting a first circuit assembly 122 and a second circuit assembly 124. The right angle or angled electrical receptacle 100 is for electrically and mechanically interconnecting a circuit assembly and a plurality of terminals having a plurality of first contacts arranged in rows and columns in a header housing or shroud.

Figure 5:
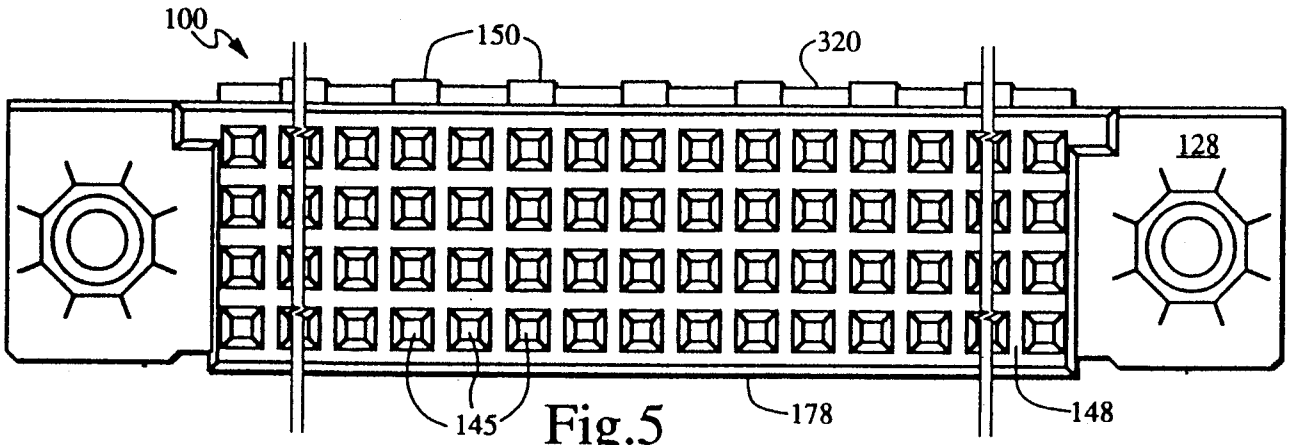
FIG. 5 is an enlarged view of the top or first mating side of a high density right angle or angled receptacle of FIG. 3.
Figure 6:
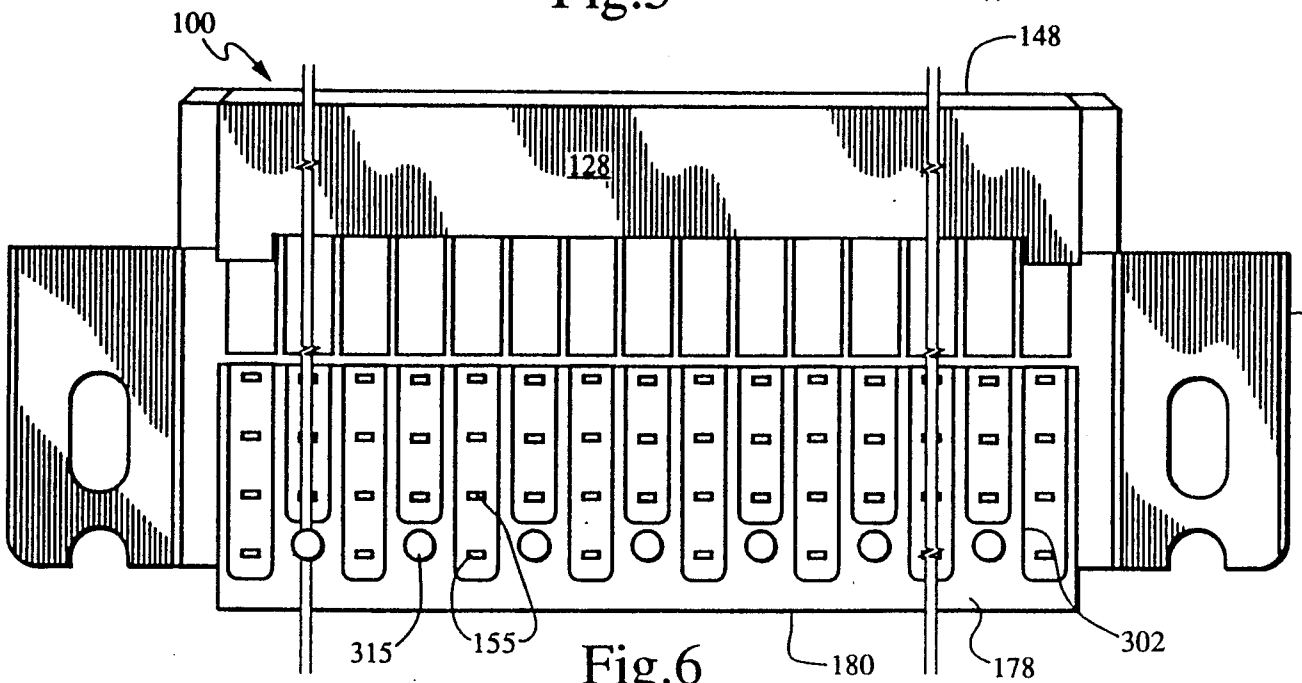
FIG. 6 is an enlarged view of a front or second mating side of the right angle or angled receptacle of FIG. 3.
Figure 8:
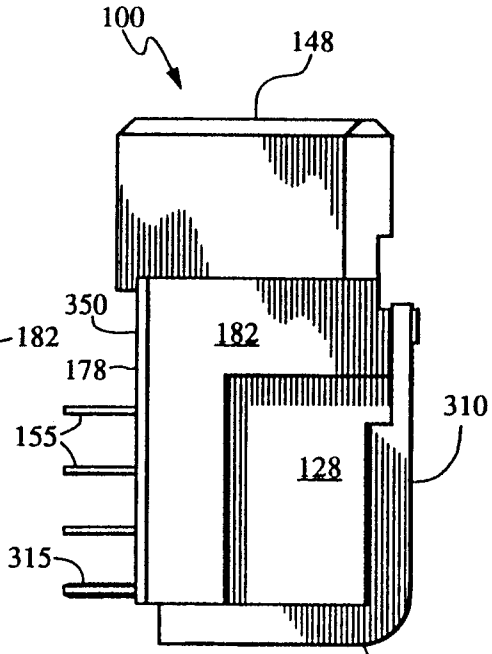
FIG. 8 is an enlarged view of an end of the right angle or angled receptacle of FIG. 3.
Figure 7:
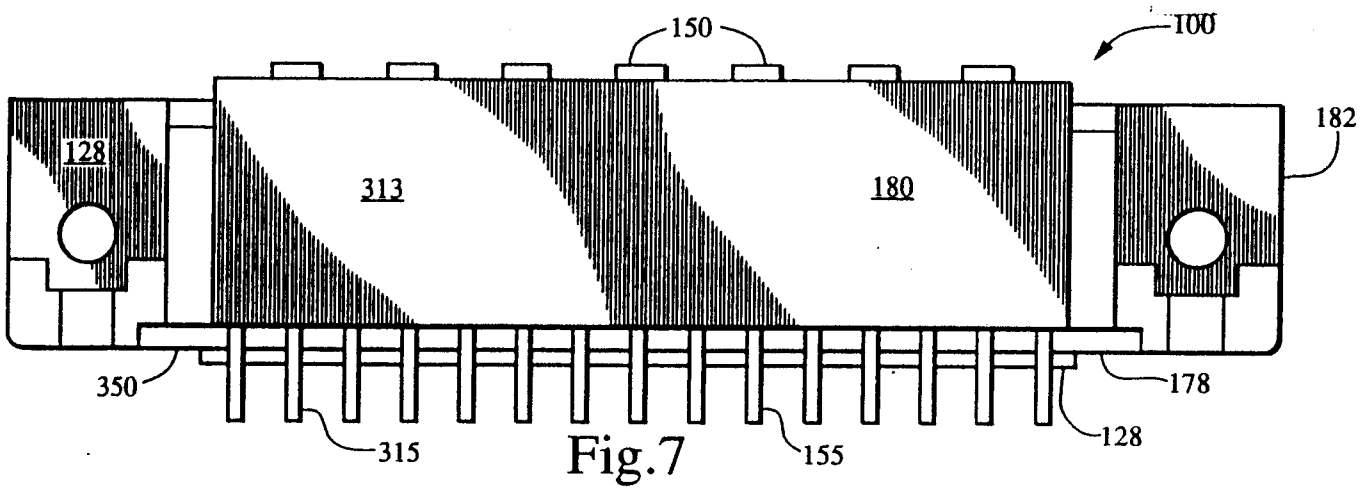
FIG. 7 is an enlarged view of a back side of the right angle or angled receptacle of FIG. 3.

FIG. 5 is an enlarged view of the top or first mating side 148 of the high density right angle or angled receptacle 100 of FIG. 3. FIG. 6 is an enlarged view of a front or second mating side 178 of the right angle or angled receptacle 100 of FIG. 3. FIG. 7 is an enlarged view of a back side 180 of the right angle or angled receptacle 100 of FIG. 3. FIG. 8 is an enlarged view of an end 182 of the right angle or angled receptacle 100 of FIG. 3. Referring to FIGS. 3 and 5-8, the right angle or angled receptacle 100 comprises an insulative housing 128, a plurality of conductive electrical contact elements 135 mounted in the housing 128 and a conductive shield 300.

The insulative housing 128 has a first, header or shroud, mating surface 148. Preferably, the housing 128 has a plurality of passages 184 arranged in rows and columns extending perpendicularly from the first mating surface 148 through the housing 128.

Figure 9:
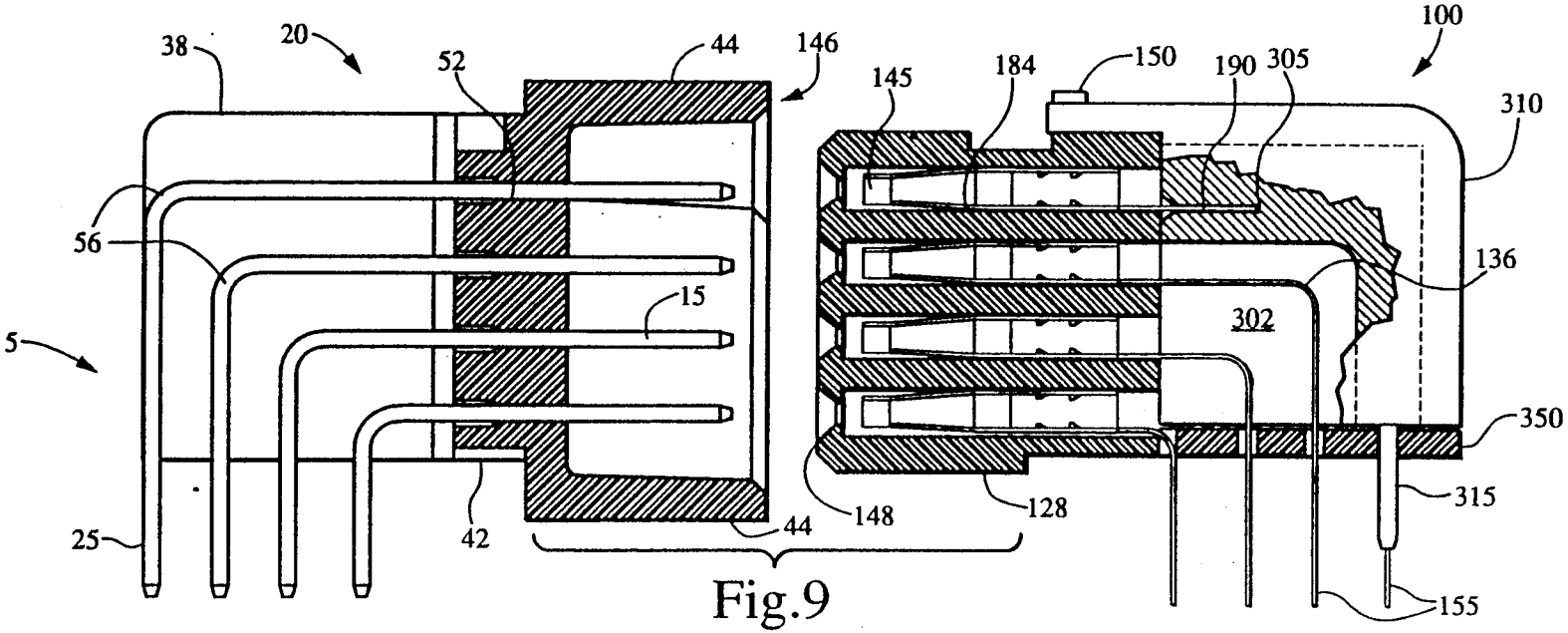
FIG. 9 is a sectional view of the right angle or angled receptacle of FIGS. 3–8 exploded from the right angle or angled header of FIG. 1.

The conductive electrical contact elements 135 may have any configuration so long as they are useable as right angle or angled contact elements. In other words, they may be male elements, female elements or gender neutral. More specifically, each one of the conductive electrical contact elements 135 has a second contact 145 and a third contact 155. The second contacts 145 can be socket shaped or spring beams. The third contacts 155 can be substantially flat solder tails. One of the second contacts 145 is secured in each one of the passages 184 for contacting one of the first contacts 65. The second contacts 155 are generally parallel to one another and arranged in rows and columns. There can be any number of rows and any number of columns of the second contacts 145. However, there are preferably at least two rows and at least two columns. Typically, there are three, four, five or six rows of the second contacts 145. The Figures depict four rows of the second contacts 145. Typically, there are many columns of the second contacts 145. Each one of the contact elements 135, except the contact elements 135 with their second contacts 145 in the nth row of the passages 184, has a middle portion 136 configured such that their third contacts 155 extend at an angle or perpendicularly with respect to the second contacts 145. The middle portions 136 may have a right angle bend, two 45 degree angle bends, etc. In FIGS. 9 and 10, the nth row is the fourth row of the second contacts 145 from the right. The contact elements 135 in the fourth row are the longest contact elements 135. A first set 188 of the contact elements 135 with their second contacts 145 in the nth row of the passages 184 have a middle portion 136 configured such that their third contacts 155 extend perpendicularly to the second contacts 145. These middle portions 136 may have a right angle bend, two 45 degree angle bends or any shape that results in the third contacts 155 extending perpendicularly to the second contacts 145. There is also a second set 190 of at least one of the contact elements 135 with its/their second contacts 145 in the nth row of the passages 184. Preferably, the first set 188 comprises a plurality of the contact elements 135 in the nth row. Preferably, the second set 190 comprises a plurality of the contact elements in the nth row. Preferably, the third contacts 155 of the second set 190 of the contact elements 135 are substantially flat solder tails. Preferably, the third contacts 155 of the second set 190 of the contact elements 135 are generally colinear or parallel to the second contacts 145. Also preferably, one of the second set 190 is between every pair of the first set 188. The third contacts 155, except those of the second set 190, can be through mount contacts or surface mount contacts.

Figure 4:
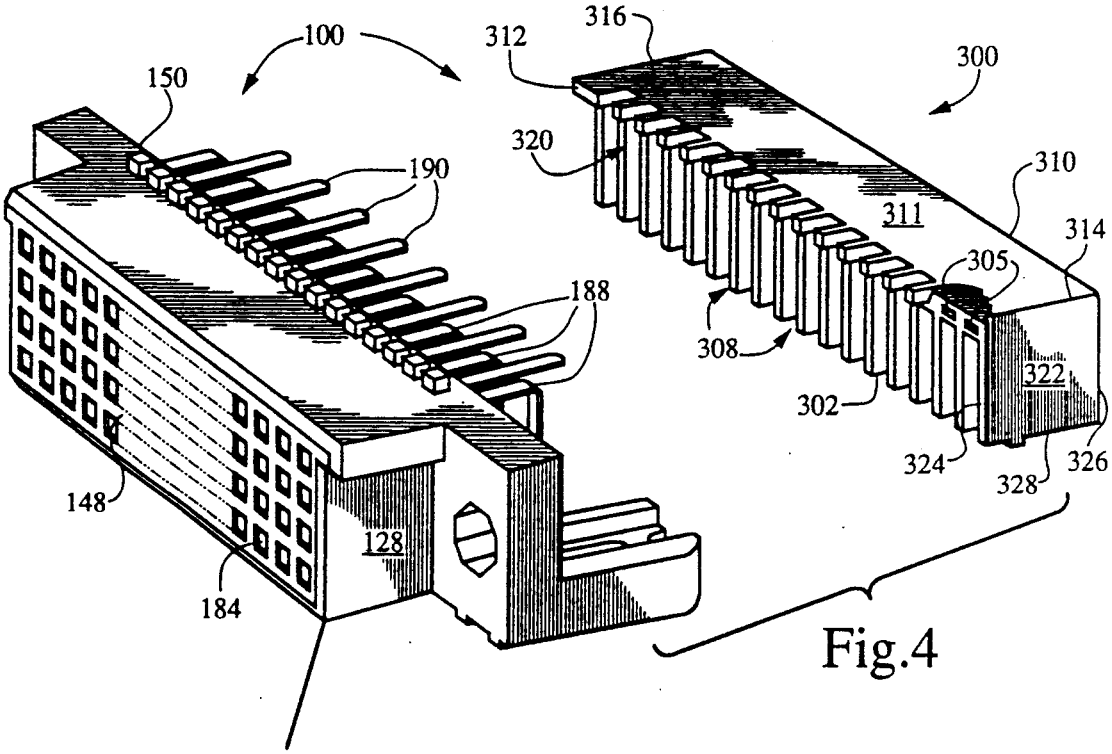
FIG. 4 is a perspective view of the high density right angle or angled receptacle of FIG. 3, the receptacle including a shield exploded from a housing, the view directed generally towards a top or first mating side of the receptacle.

FIG. 4 is a perspective view of the high density right angle or angled receptacle 100 of FIG. 3, the receptacle 100 including the shield 300 exploded from the housing 128, the view directed generally towards the top or first mating side 148 of the receptacle 100. The shield 300 includes a baffle 302 positioned between and spaced from columns of the middle portions 136 of the contact elements 135. Preferably, one of the baffles 302 is between each pair of adjacent columns of the middle portions 136 of the contact elements 135. The shield 300 and the baffles 302 can be made of any conductive material. Alternatively, the shield 300 and/or the baffles 302 can be polymeric and have a conductive layer or coating. The shield 300 includes a fourth contact 305 for contacting each of the third contacts 155 of the second set 190 of the contact elements 135. Preferably, the fourth contacts 305 are slots or holes in the shield 300 for receiving the third contacts 155 of the second set 190 of the contact elements 135. The shield 300 further includes a plurality of fifth contacts 315 positioned such that the fifth contacts 315 and the third contacts 155, excluding the third contacts 155 of the second set 190 of the contact elements 135 in the nth row, are arranged in rows and columns for connection to the circuit assembly 124. It is within the scope of this invention for the fifth contacts 315 to be arranged in one or more rows and in such row(s) with or without third contacts 155 positioned in the row(s) with the fifth contacts 315. Preferably, the fifth contacts 315 are pin shaped. The fifth contacts 315 can have a different shaped than the third contacts 155. For instance, both the third contacts 155 and the fifth contacts 315 can be pin shaped, but the cross section of one of them, such as the fifth contacts 315 can be larger than the cross section of the other. The fifth contacts 315 can be cast out of the same metal as the rest of the shield 300. Alternatively, the fifth contacts 315 can be conductive pins secured in holes in or through a wall 310 of the shield 300. Preferably, the shield 300 further comprise an elongated outer side wall 310 connected to each of the baffles 302. The elongated outer side wall 310 and adjacent pairs of the baffles 302 define pockets 308 for the middle portion 136 of one column of the contact elements 135. To ensure that the middle portions 136 do not short out by contacting a conductive portion of the shield 300, the pockets 308 can be coated with an insulative layer 309. The elongated outer side wall 310 may extend generally between the housing 128 and the third contacts 155. The elongated outer side wall 310 may be one continuous wall with a bend generally following the bend of the middle portions 136 of the contact elements 135. If the bend of the elongated outer wall 310 is substantially a right angle bend, then the elongated outer wall 310, in effect, becomes a first elongated outer wall 311 connected to a second elongated outer side wall 313. The elongated outer side wall 310 may have a first edge 312, a second edge 314, a third edge 316 and a fourth edge 318. The first edge 312 is for contacting the housing 148. The first edge 312 may have teeth, holes or projections 320 for inserting in or mating with teeth, projections or grooves 150 in the housing 148. The shield 300 may be a first end wall 322 having a first edge 324, a second edge 326 and a third edge 328. The first edge 324 of the first end wall 322 is for contacting the housing 148. The second edge 326 of the first end wall 322 may be connected to the second edge 314 of the side wall 310. The shield 300 may have a second end wall 330 having a first edge 332, a second edge 334 and a third edge 336. The first edge 332 of the second end wall 330 is for contacting the housing 148. The second edge 334 of the second end wall 330 is for connecting to the third edge 316 of the side wall 310. Alternatively, the first end wall 322 and the second end wall 330 can be connected to the housing 148 and be insulative, rather than connected to or being part of the shield 300. The middle portions 136 of the contact elements 135 are within the confines of the outer side wall 310, the first end wall 322 and the second end wall 330. The elongated outer wall 310 and/or the side walls 322, 330 may have cleaning or draining passages (not depicted). Further, there may be stand offs along the edges of the walls 310, 322, 330 to allow cleaning fluids to pass through the connector 100.

The right angle or angled electrical receptacle 100 may further include an insulative spacer 350 having a plurality of holes 352 arranged in rows and columns. The spacer 350 may have stand offs 351. The contact elements 135, except the second set 190, can extend through the holes 352 such that the fifth contacts 315 and the third contacts 155, excluding the third contacts 155 of the second set 188 of the contact elements 135 in the nth row, are on one side of the spacer 350 and the middle portions 136 are on another side of the spacer 350. The spacer 350 can have sleeves (not depicted) extending from the holes 352 for insertion into the pockets 308 to reduce lateral movement of the spacer 350 and the third contacts 155 with respect to the shield 300.

FIG. 9 is a sectional view of the right angle or angled receptacle 100 of FIGS. 3–8 exploded from the right angle or angled header 20 of FIG. 1. FIG. 10 is a sectional view of the right angle or angled receptacle 100 of FIGS. 3–8 exploded from the vertical header 40 of FIG. 2. Note, however, the second contacts 145 of the high density receptacle 100 are not limited to only connecting to the first contacts of the HPC vertical header 20 or the HPC right angle or angled header 20. The second contacts 145 of the high density receptacle 100 can connect to any plurality of terminals or contact elements with a plurality of first contacts arranged in rows and columns in a contact region of a housing secured to the terminals or a shroud surrounding the terminals. The header that is mateable with the receptacle 100 can be a vertical header or a right angle or angled header. Preferably, the terminals of the header that is mateable with the receptacle 100 are pins having a 0.24 inches by 0.24 inches square cross section. If the header that is mated with the receptacle 100 is a right angle or angled header, then preferably it is the right angle or angled header 200 illustrated in FIG. 11.

The first and second circuit assemblies 122, 124 can be any assemblies that include a plurality of conductors, leads, plated through holes or conductive paths, pads or areas 126. Each or either one of the circuit assemblies 122, 124 can be a printed wiring board or a printed circuit board, such as a backpanel, a mother board or a daughter board. Each or either one of the circuit assemblies 122, 124 can be a cable assembly. The circuit assemblies 122, 124 can be rigid or flexible. In one typically situation, the header 20 is for electrically and mechanically connecting to a backpanel or mother board and the receptacle 100 is for electrically and mechanically connecting to a daughter board that is perpendicular to the mother board.

FIG. 11 is an exploded perspective view of a second embodiment of a high density connector assembly in accordance with the present invention. The assembly includes the high density receptacle 100 and a high density right angle or angled header 200 for interconnecting a first one of the circuit assemblies 222 and a second one of the circuit assemblies 224. The right angle or angled electrical header 200 is for electrically and mechanically interconnecting a circuit assembly and a plurality of terminals with a plurality of first contacts arranged in rows and columns in a receptacle.

Figure 15:
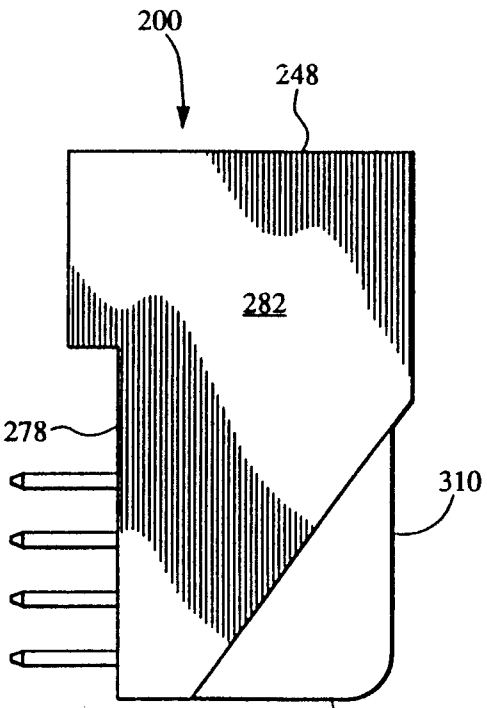
FIG. 15 is an enlarged view of an end of the right angle or angled header of FIG. 11.
Figure 12:
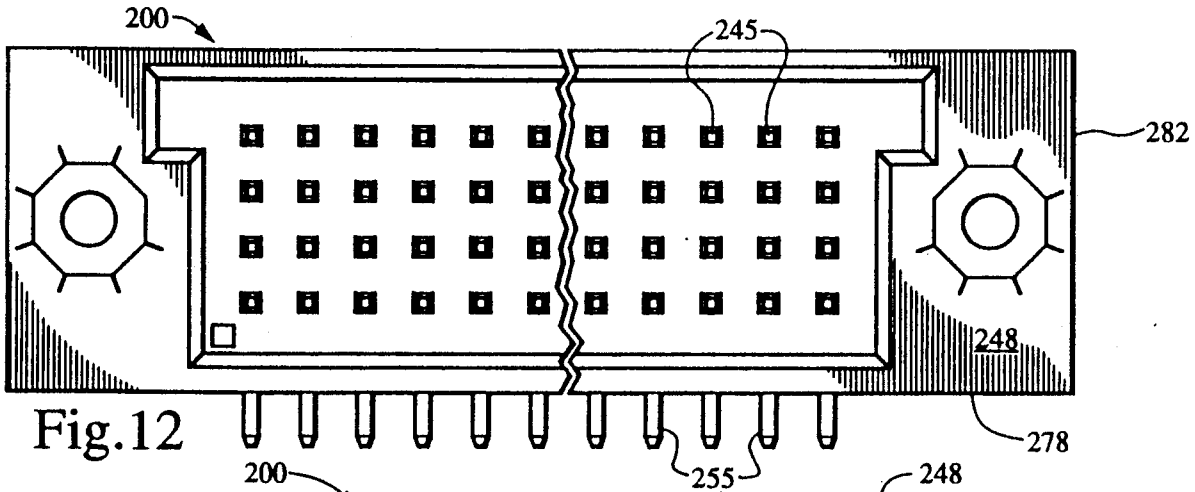
FIG. 12 is an enlarged view of a top or first mating side of a high density right angle or angled header of FIG. 11.
Figure 13:
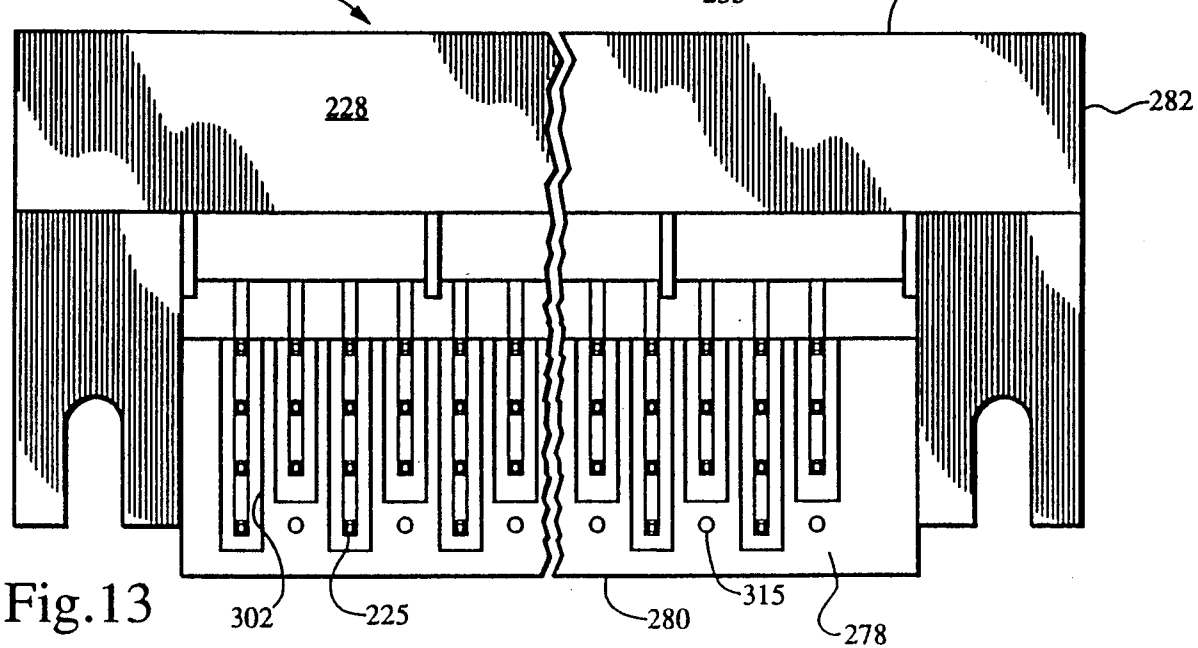
FIG. 13 is an enlarged view of a front or second mating side of the right angle or angled header of FIG. 11.
Figure 14:
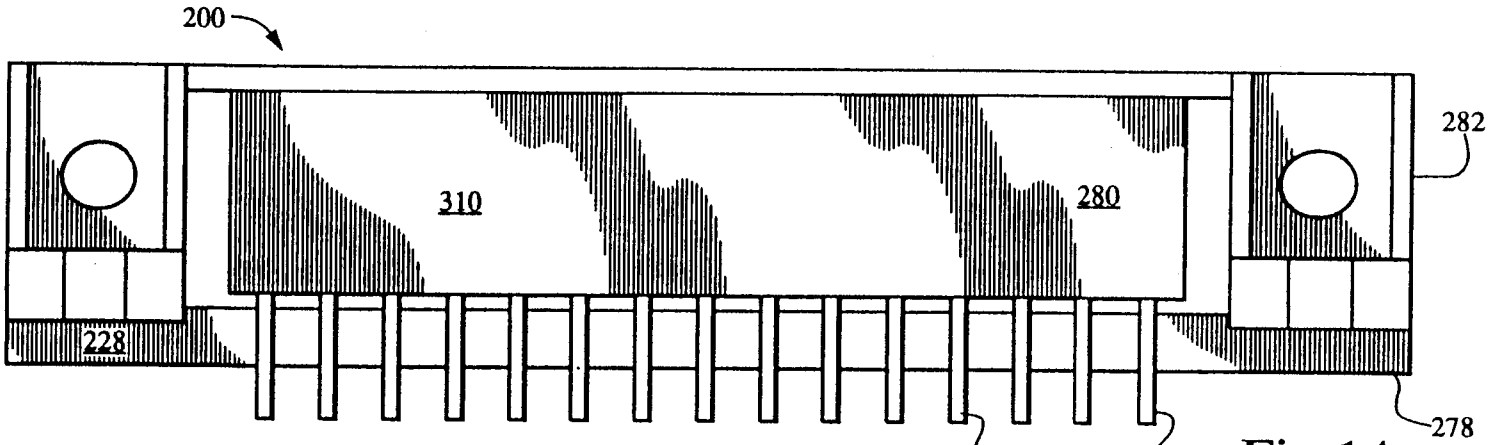
FIG. 14 is an enlarged view of a back side of the right angle or angled header of FIG. 11.

FIG. 12 is an enlarged view of a top or first mating side 248 of the high density right angle or angled header 200 of FIG. 11. FIG. 13 is an enlarged view of a front or second mating side 278 of the right angle or angled header 200 of FIG. 11. FIG. 14 is an enlarged view of a back side 280 of the right angle or angled header 200 of FIG. 11. FIG. 15 is an enlarged view of an end 282 of the right angle or angled header 200 of FIG. 11. Referring to FIGS. 11–15, the right angle or angled header 200 comprises an insulative housing 228, a plurality of conductive electrical contact elements 235 mounted in the housing 228 and a conductive shield 300'.

The insulative housing 228 has a first, receptacle, mating surface 248. The insulative housing 228 may have a base 142 and side walls 144 extending generally perpendicularly from the base 142. The base 142 and the side walls 144 partially enclosing a contact region 146. A plurality of passages 184 arranged in rows and columns extend through the base 142.

The conductive electrical contact elements 235 may have any configuration so long as they are useable as right angle or angled contact elements. In other words, they may be male elements, female elements or gender neutral. More specifically, each one of the electrical contact elements 235 has a second contact 245 and a third contact 255. Preferably, the second contacts 245 and the third contacts 255 are distal end portions of a pin generally having a 0.24 inches by 0.24 inches square cross section. One of the contact elements 235 is fixed in each of the passages 284 with the second contacts 245 positioned in the contact region 246 for contacting one of the first contacts (such as contacts 145) of a mating receptacle (such as receptacle 100). The second contacts 245 are generally parallel to one another and arranged in rows and columns. There can be any number of rows and any number of columns of the second contacts. However, there are preferably at least two rows and at least two columns. Typically, there are three, four, five or six rows of the second contacts 245. The Figures depict four rows of the second contacts 245. Typically, there are many columns of the second contact elements 235. Each one of the contact elements 235, except the contact elements 235 with their second contacts 245 in the nth row of the passages 284, has a middle portion 236 configured such that their third contacts 255 extend at an angle or perpendicularly with respect to the second contacts 245. The middle portions 236 may have a right angle bend, two 45 degree angle bends, etc. In the embodiment illustrated in FIGS. 11–15, the nth row is the fourth row. The contact elements 235 in the fourth row are the longest contact elements 235. A first set 288 of the contact elements 235 with their second contacts 245 in the nth row of the passages 284 have a middle portion 136 configured such that their third contacts 255 extend perpendicularly to the second contacts 245. These middle portions 236 may have a right angle bend, two 45 degree angle bends or any shape that results in the third contacts 236 extending perpendicularly to the second contacts 245. There is also a second set 290 of at least one of the contact elements 235 with its/their second contacts 245 in the nth row of the passages 284. Preferably, the first set 288 comprises a plurality of the contact elements 235 in the nth row. Preferably, the second set 290 comprises a plurality of the contact elements 235 in the nth row. Preferably, the third contacts 255 of the second set 290 of the contact elements 235 are generally colinear or parallel to the second contacts 245. Also preferably, one of the second set 290 is between every pair of the first set 288. The third contacts 255, except those of the second set 290, can be through mount contacts or surface mount contacts.

Referring to FIG. 11, the conductive shield 300' is connectable to the housing 228 by any means. The shield 300' differs from the shield 300 in that the shield 300' is not depicted with the teeth 320. However, the shield 300' could have teeth 320 in which case the housing 228 would have mating projections (like projections 150). The shield 300' includes a baffle 302 positioned between and spaced from columns of the middle portions 236 of the contact elements 235. Preferably, one of the baffles 302 is between each pair of adjacent columns of the middle portions 236 of the contact elements 235. The shield 300' and the baffles 302 can be made of any conductive material. Alternatively, the shield 300' and/or the baffles 302 can be polymeric and have a conductive layer or coating. The shield 300' includes a fourth contact 305 for contacting each of the third contacts 255 of the second set 290 of the contact elements 235. Preferably, the fourth contacts 305 are slots or holes in the shield 300' for receiving the third contacts 255 of the second set 290 of the contact elements 235. The shield 300' further includes a plurality of fifth contacts 315 positioned such that the fifth contacts 315 and the third contacts 255, excluding the third contacts 255 of the second set 290 of the contact elements 235 in the nth row, are arranged in rows and columns for connection to the circuit assembly 224. It is within the scope of this invention for the fifth contacts 315 to be arranged in one or more rows and in such row(s) with or without third contacts 255 positioned in the row(s) with the fifth contacts 315. Preferably, the fifth contacts 315 are pin shaped. The fifth contacts 315 can have a different shape than the third contacts 255. For instance, both the third contacts 255 and the fifth contacts 315 can be pin shaped, but the cross section of one of them, such as the fifth contacts 315 can be larger than the cross section of the other. The fifth contacts 315 can be cast out of the same metal as the rest of the shield 300'. Alternatively, the fifth contacts 315 can be conductive pins secured in holes in a wall 310 of the shield 300'. Preferably, the shield 300' further comprise an elongated outer side wall 310 connected to each of the baffles 302. The elongated outer side wall 310 and adjacent pairs of the baffles 302 define a pocket 308 for the middle portion 236 of one column of the contact elements 235. To ensure that the middle portions 236 do not short out by contacting a conductive portion of the shield 300', the pockets 308 can be coated with an insulative layer. The elongated outer side wall 310 may extend generally between the housing 228 and the third contacts 255. The elongated outer side wall 310 may be one continuous wall with a bend generally following the bend of the middle portions 236 of the contact elements 135. If the bend of the elongated outer wall 310 is substantially a right angle bend, then the elongated outer wall 310, in effect, becomes a first elongated outer wall 311 connected to a second elongated outer side wall 313. The elongated outer side wall 310 may have a first edge 312, a second edge 314, a third edge 316 and a fourth edge 318. The first edge 312 is for contacting the housing 248. The shield may have a first end wall 322 having a first edge 324, a second edge 326 and a third edge 328. The first edge 324 of the first end wall 322 is for contacting the housing 248. The second edge 326 of the first end wall 322 may be connected to the second edge 314 of the side wall 310. The shield 300' may have a second end wall 330 having a first edge 332, a second edge 334 and a third edge 336. The first edge 332 of the second end wall 330 is for contacting the housing 248. The second edge 334 of the second end wall 330 is for connecting to the third edge 316 of the side wall 310. Alternatively, the first end wall 322 and the second end wall 330 can be connected to the housing 248, rather than to the shield 300'. The middle portions 236 of the contact elements 235 are within the confines of the outer side wall 310, the first end wall 322 and the second end wall 330. The elongated outer wall 310 and/or the side walls 322, 330 may have cleaning or draining passages (not depicted). Further, there may be stand offs along the edges of the walls 310, 322, 330 to allow cleaning fluids to pass through the connector 200.

The right angle or angled header 200 may further include an insulative spacer (not depicted), like the insulative spacer 350. However, if the contact elements 235 are pins with a 0.24 inches by 0.24 inches square cross section, they are generally rigid enough not to use the insulative spacer.

Figure 16:
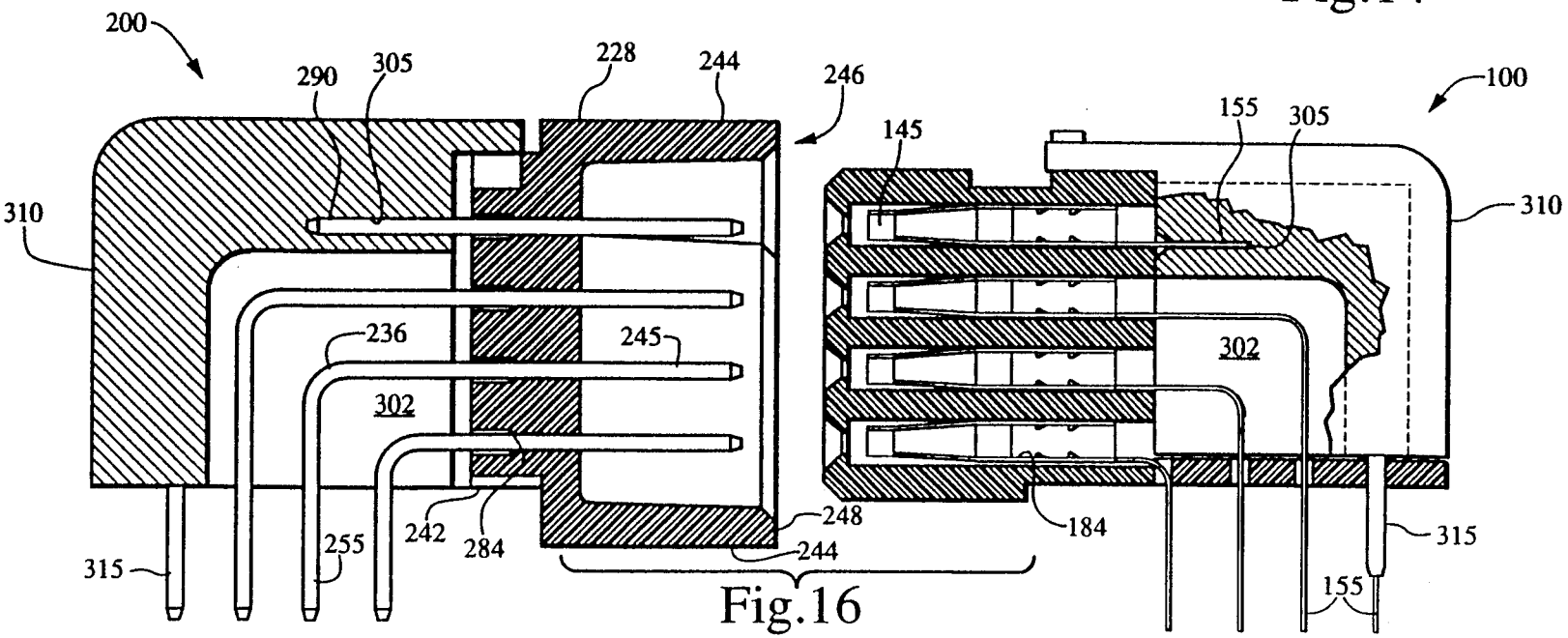
FIG. 16 is a sectional view of the right angle or angled receptacle of FIGS. 3–11 exploded from the right angle or angled header of FIGS. 11–15.

FIG. 16 is a sectional view of the right angle or angled receptacle 100 of FIGS. 3–11 exploded from the right angle or angled header 200 of FIG. 1!. Note, however, the second contacts 245 of the high density header 200 are not limited to only connecting to the contacts 145 of the high density receptacle 200. The second contacts 245 of the high density header 200 also mate with the first contacts of the HPC vertical receptacle 30 or the first contacts of the HPC right angle receptacle 10. Furthermore, the second contacts 245 of the high density header 200 can connect to any plurality of terminals or contact elements with a plurality of first contacts arranged in rows and columns in a receptacle. The receptacle that is mateable with the header 200 can be a vertical receptacle or a right angle or angled receptacle. Preferably, the first contacts of the receptacle that is mateable with the header 200 are sockets or spring beams. If the receptacle that is mated with the header 200 is a right angle receptacle, then preferably it is the right angle receptacle 100 illustrated in FIG. 11.

It is further noted that the conductive U-shaped structures disclosed in U.S. Pat. No. 4,898,546 can be used in combination with the present invention to connect any of the contact elements 135, 235 to the shields 300, 300' and, thus, to ground, including the contact elements 135, 235 that are not in the nth row. Specifically, one or more of the U-shaped structures can be used as disclosed in U.S. Pat. No. 4,898,546. However, instead of securing the U-shaped structures in an insulative comb-like member, the U-shaped structures can be secured in the pockets 308 of the conductive shields 300, 300'.

It will be recognized by those skilled in the art that the ground structures or shields of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetheremide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, pladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An angled or right angle electrical connector for electrically and mechanically interconnecting a circuit assembly and a second connector having a plurality of terminals, each terminal having a first contact, the first contacts arranged in rows and columns, the right angle or angled connector comprising:

an insulative housing;

a plurality of electrical contact elements in the housing wherein:

each one of the contact elements has a second contact and a third contact, the second contacts are arranged in rows and columns for contacting the first contacts, each one of the contact elements, except the contact elements with their second contacts in the nth row, includes a middle portion configured such that their third contacts extend at an angle with respect to the second contacts, a first set of a plurality of the contact elements with their second contacts in the nth row having a middle portion configured such that their third contacts extend at an angle with respect to the second contacts, and a second set of a plurality of the contact elements with their second contacts in the nth row; and a conductive shield electrically connected to the second set, but not the first set, of the contact elements.

2. An angled or right angle electrical connector for electrically and mechanically interconnecting a circuit assembly and a second connector having a plurality of terminals, each terminal having a first contact, the first contacts arranged in rows and columns, the right angle or angled connector comprising:

an insulative housing;

a plurality of electrical contact elements in the housing wherein:

each one of the contact elements has a second contact and a third contact, the second contacts are arranged in rows and columns for contacting the first contacts, each one of the contact elements, except the contact elements with their second contacts in the nth row, includes a middle portion configured such that their third contacts extend at an angle with respect to the second contacts, a first set of the contact elements with their second contacts in the nth row having a middle portion configured such that their third contacts extend at an angle with respect to the second contacts, and a second set of the contact elements with their second contacts in the nth row; and a conductive shield including:

a baffle positioned between and spaced from columns of the middle portions of the contact elements, a fourth contact for contacting each of the third contacts of the second set, but not the third contacts of the first set, of the contact element, and a plurality of fifth contacts positioned such that the third contacts, excluding the third contacts of the second set of contact elements in the nth row, and the fifth contacts are arranged in rows and columns for connection to the circuit assembly.

3. The right angle or angled electrical connector of claim 2, wherein the third contacts of the second set of the contact elements are colinear or parallel to the second contacts.

4. The right angle or angled electrical connector of claim 2, wherein one of the second set is between every pair of the first set.

5. The right angle or angled electrical connector of claim 2, further comprising:

an insulative spacer having a plurality of holes arranged in rows and columns; and the contact elements, except the second set, extending through the holes such that the third and fifth contacts are on one side of the spacer and the middle portions are on another side of the spacer.

6. The right angle or angled electrical connector of claim 2, wherein the middle portions have a right angle bend.

7. The right angle or angled electrical connector of claim 2, wherein the fourth contacts are slots or holes in the shield.

8. An angled or right angle electrical connector for electrically and mechanically interconnecting a circuit assembly and a second connector having a plurality of terminals, each terminal having a first contact, the first contacts arranged in rows and columns, the right angle or angled connector comprising:

an insulative housing;

a plurality of electrical contact elements in the housing wherein:

each one of the contact elements has a second contact and a third contact, the second contacts are arranged in rows and columns for contacting the first contacts, each one of the contact elements, except the contact elements with their second contacts in the nth row, includes a middle portion configured such that their third contacts extend at an angle with respect to the second contacts, a first set of the contact elements with their second contacts in the nth row having a middle portion configured such that their third contacts extend at an angle with respect to the second contacts; and a second set of the contact elements with their second contacts in the nth row; and a conductive shield including:

a baffle positioned between and spaced from columns of the middle portions of the contact elements, a fourth contact for contacting each of the third contacts of the second set of the contact elements;

a plurality of fifth contacts positioned such that the third contacts, excluding the third contacts of the second set of contact elements in the nth row, and the fifth contacts are arranged in rows and columns for connection to the circuit assembly;

an elongated outer side wall connected to each of the baffles, the side wall having a first edge, a second edge, a third edge and a fourth edge, the first edge contacting the housing;

a first end wall having a first edge, a second edge and a third edge, the first edge of the first end wall contacting the housing, the second edge of the first end wall connected to the second edge of the side wall; and a second end wall having a first edge, a second edge and a third edge, the first edge of the second end wall contacting the housing, the second edge of the second end wall connected to the third edge of the side wall, such that the middle portions of the contact elements are within the confines of the outer side wall, the first end wall and the second end wall.

9. The right angle or angled electrical connector of claim 2, wherein the contact elements in the nth row are the longest contact elements.

10. An angled or right angle electrical receptacle for electrically and mechanically interconnecting a circuit assembly and a plurality of terminals with a plurality of first contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a second contact and a third contact, one of the second contacts positioned in each one of the passages for contacting one of the first contacts, each one of the contact elements, except the contact elements with their second contacts in the nth row of the passages, having a middle portion configured such that their third contacts extend at an angle with respect to the second contacts, a first set of a plurality of the contact elements with their second contacts in the nth row of the passages having a middle portion configured such that their third contacts extend at an angle with respect to the second contacts, and a second set of a plurality of the contact elements with their second contacts in the nth row; and a conductive shield electrically connected to the second set, but not the first set, of the contact elements.

11. An angled or right angle electrical receptacle for electrically and mechanically interconnecting a circuit assembly and a plurality of terminals with a plurality of first contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a second contact and a third contact, one of the second contacts positioned in each one of the passages for contacting one of the first contacts, each one of the contact elements, except the contact elements with their second contacts in the nth row of the passages, having a middle portion configured such that their third contacts extend at an angle with respect to the second contacts, a first set of the contact elements with their second contacts in the nth row of the passages having a middle portion configured such that their third contacts extend at an angle with respect to the second contacts, and a second set of the contact elements with their second contacts in the nth row; and a conductive shield including:

a baffle positioned between and spaced from columns of the middle portions of the contact elements, a fourth contact for contacting each of the third contacts of the second set, but not the third contacts of the first set, of contact elements, and a plurality of fifth contacts positioned such that the fifth contacts and the third contacts, excluding the third contacts of the second set of contact elements in the nth row, are arranged in rows and columns for connection to the circuit assembly.

12. The right angle or angled electrical receptacle of claim 11, wherein the third contacts of the second set of the contact elements are colinear or parallel to the second contacts.

13. The right angle or angled electrical receptacle of claim 11, wherein one of the second set is between every pair of the first set.

14. The right angle or angled electrical receptacle of claim 11, further comprising:

an insulative spacer having a plurality of holes arranged in rows and columns; and the contact elements, except the second set, extending through the holes such that the fifth contacts and the third contacts, excluding the third contacts of the second set of contact elements in the nth row, are on one side of the spacer and the middle portions are on another side of the spacer.

15. The right angle or angled electrical receptacle of claim 11, wherein the middle portions have a right angle bend.

16. The right angle or angled electrical receptacle of claim 11, wherein the fourth contacts are slots or holes in the shield.

17. An angled or right angle electrical receptacle for electrically and mechanically interconnecting a circuit assembly and a plurality of terminals with a plurality of first contacts arranged in rows and columns in a header or shroud, the receptacle comprising:

an insulative housing having a first, header or shroud, mating surface and a plurality of passages arranged in rows and columns extending perpendicularly from the first mating surface through the housing;

a plurality of electrical contact elements, each one of the contact elements having a second contact and a third contact, one of the second contacts positioned in each one of the passages for contacting one of the first contacts, each one of the contact elements, except the contact elements with their second contacts in the nth row of the passages, having a middle portion configured such that their third contacts extend at an angle with respect to the second contacts, a first set of the contact elements with their second contacts in the nth row of the passages having a middle portion configured such that their third contacts extend at an angle with respect to the second contacts, and a second set of the contact elements with their second contacts in the nth row; and a conductive shield including:

a baffle positioned between and spaced from columns of the middle portions of the contact elements, a fourth contact for contacting each of the third contacts of the second set of contact elements;

a plurality of fifth contacts positioned such that the fifth contacts and the third contacts, excluding the third contacts of the second set of contact elements in the nth row, are arranged in rows and columns for connection to the circuit assembly;

an elongated outer side wall connected to each of the baffles, the side wall having a first edge, a second edge, a third edge and a fourth edge, the first edge contacting the housing;

a first end wall having a first edge, a second edge and a third edge, the first edge of the first end wall contacting the housing, the second edge of the first end wall connected to the second edge of the side wall; and a second end wall having a first edge, a second edge and a third edge, the first edge of the second end wall contacting the housing, the second edge of the second end wall connected to the third edge of the side wall, such that the middle portions of the contact elements are within the confines of the outer side wall, the first end wall and the second end wall.

18. The right angle or angled electrical receptacle of claim 11, wherein:

the first contacts comprise pins;

the second contacts comprise sockets;

the third contacts comprise solder tails; and the fifth contacts are pin shaped.

19. The right angle or angled electrical receptacle of claim 11, wherein the contact elements in the nth row are the longest contact elements.

20. An angled or right angle electrical header for electrically and mechanically interconnecting a circuit assembly and a plurality of terminals with a plurality of first contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements, each one of the contact elements having a second contact and a third contact, one of the contact elements fixed in each of the passages with the second contacts positioned in the contact region for contacting one of the first contacts, each one of the contact elements, except the contact elements in the nth row of the passages, having a middle portion configured such that their third contacts extend at an angle with respect to the second contacts, a first set of a plurality of the contact elements in the nth row of the passages having a middle portion configured such that their third contacts extend at an angle with respect to the second contacts, and a second set of a plurality of the contact elements in the nth row of the passages; and a conductive shield electrically connected to the second set, but not the first set, of the contact elements.

21. An angled or right angle electrical header for electrically and mechanically interconnecting a circuit assembly and a plurality of terminals with a plurality of first contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements, each one of the contact elements having a second contact and a third contact, one of the contact elements fixed in each of the passages with the second contacts positioned in the contact region for contacting one of the first contacts, each one of the contact elements, except the contact elements in the nth row of the passages, having a middle portion configured such that their third contacts extend at an angle with respect to the second contacts, a first set of the contact elements in the nth row of the passages having a middle portion configured such that their third contacts extend at an angle with respect to the second contacts, and a second set of the contact elements in the nth row of the passages; and a conductive shield including:

a baffle positioned between and spaced from columns of the middle portions of the contact elements, a fourth contact for contacting each of the third contacts of the second set, but not the third contacts of the first set, of contact elements, and a plurality of fifth contacts positioned such that the fifth contacts and the third contacts, excluding the third contacts of the second set of contact elements in the nth row, are arranged in rows and columns for connection to the circuit assembly.

22. The right angle or angled electrical header of claim 21, wherein the third contacts of the second set of the contact elements are colinear or parallel to the second contacts.

23. The right angle or angled electrical header of claim 21, wherein one of the second set is between every pair of the first set.

24. The right angle or angled electrical header of claim 21, further comprising:

an insulative spacer having a plurality of holes arranged in rows and columns; and the contact elements, except the second set, extending through the holes such that the fifth contacts and the third contacts, excluding the third contacts of the second set of contact elements in the nth row, are on one side of the spacer and the middle portions are on another side of the spacer.

25. The right angle or angled electrical header of claim 21, wherein the middle portions have a right angle bend.

26. The right angle or angled electrical header of claim 21, wherein the fourth contacts are slots or holes in the shield.

27. An angled or right angle electrical header for electrically and mechanically interconnecting a circuit assembly and a plurality of terminals with a plurality of first contacts arranged in rows and columns in a receptacle, the header comprising:

an insulative housing having a base and side walls, the base and the side walls partially enclosing a contact region, the base having a plurality of passages arranged in rows and columns extending through the base;

a plurality of electrical contact elements, each one of the contact elements having a second contact and a third contact, one of the contact elements fixed in each of the passages with the second contacts positioned in the contact region for contacting one of the first contacts, each one of the contact elements, except the contact elements in the nth row of the passages, having a middle portion configured such that their third contacts extend at an angle with respect to the second contacts, a first set of the contact elements in the nth row of the passages having a middle portion configured such that their third contacts extend at an angle with respect to the second contacts, and a second set of the contact elements in the nth row of the passages; and a conductive shield including:

a baffle positioned between and spaced from columns of the middle portions of the contact elements;

a fourth contact for contacting each of the third contacts of the second set of contact elements;

a plurality of fifth contacts positioned such that the fifth contacts and the third contacts, excluding the third contacts of the second set of contact elements in the nth row, are arranged in rows and columns for connection to the circuit assembly;

an elongated outer side wall connected to each of the baffles, the side wall having a first edge, a second edge, a third edge and a fourth edge, the first edge contacting the housing;

a first end wall having a first edge, a second edge and a third edge, the first edge of the first end wall contacting the housing, the second edge of the first end wall connected to the second edge of the side wall; and a second end wall having a first edge, a second edge and a third edge, the first edge of the second end wall contacting the housing, the second edge of the second end wall connected to the third edge of the side wall, such that the middle portions of the contact elements are within the confines of the outer side wall, the first end wall and the second end wall.

28. The right angle or angled electrical header of claim 21, wherein:

the first contacts comprise pins;

the second contacts comprise sockets;

the third contacts comprise solder tails; and the fifth contacts are pin shaped.

29. The right angle or angled electrical header of claim 21, wherein the contact elements in the nth row are the longest contact elements.

30. A conductive shield for reducing cross talk between contact elements in angled or right angle connectors having an insulative housing and a plurality of the contact elements mounted in the housing, each one of the contact elements having a first contact and a second contact, the first contacts arranged in rows and columns, the shield comprising:

a plurality of baffles, each of the baffles for positioning between adjacent columns of middle portions of the contact elements such that the baffles are spaced from the contact elements, a plurality of first shield contacts, one of the first shield contacts for contacting each of the second contacts of a first set, but not a second set, of the contact elements in the nth row of contact elements, and a plurality of second shield contacts positioned such that the second contacts of the connector elements, excluding the second contacts of the first set of contact elements in the nth row, and the second shield contacts are arranged in rows and columns that are at an angle with respect to the rows and columns of the first contacts of the contact elements.

31. The shield of claim 30, wherein the first shield contacts are slots or holes in the shield.

32. The shield of claim 30, wherein the shield further comprises:

an elongated outer side wall connected to each of the baffles, the side wall having a first edge, a second edge, a third edge and a fourth edge, the first edge contacting the housing;

a first end wall having a first edge, a second edge and a third edge, the first edge of the first end wall contacting the housing, the second edge of the first end wall connected to the second edge of the side wall; and a second end wall having a first edge, a second edge and a third edge, the first edge of the second end wall contacting the housing, the second edge of the second end wall connected to the third edge of the side wall, such that the middle portions of the contact elements are within the confines of the outer side wall, the first end wall and the second end wall.

33. A conductive shield for reducing cross talk between contact elements in angled or right angle connectors having an insulative housing and a plurality of the contact elements mounted in the housing, each one of the contact elements having a first contact and a second contact, the first contacts arranged in rows and columns, the shield comprising:

a plurality of baffles coated with an insulative layer, each of the baffles for positioning between adjacent columns of middle portions of the contact elements such that the baffles are spaced from the contact elements, a plurality of first shield contacts, one of the first shield contacts for contacting each of the second contacts of a set of the contact elements in the nth row of contact elements, and a plurality of second shield contacts positioned such that the second contacts of the connector elements, excluding the second contacts of the set of contact elements in the nth row, and the second shield contacts are arranged in rows and columns that are at an angle with respect to the rows and columns of the first contacts of the contact elements.

* * * * *